US006651683B1

(12) United States Patent
Hooks et al.

(10) Patent No.: US 6,651,683 B1
(45) Date of Patent: Nov. 25, 2003

(54) METHOD FOR CARRYING A REACHER ON A WALKER AND APPARATUS THEREFOR

(76) Inventors: Lee Douglas Hooks, 718-D Gettysburg Way, Gilroy, CA (US) 95020; Therese Yukie Hooks, 718-D Gettysburg Way, Gilroy, CA (US) 95020

( * ) Notice: Subject to any disclaimer, the term of this patent is extended or adjusted under 35 U.S.C. 154(b) by 62 days.

(21) Appl. No.: 10/142,029

(22) Filed: May 9, 2002

(51) Int. Cl.[7] ..... B60R 9/00
(52) U.S. Cl. ..... 135/66; 224/407; 135/67
(58) Field of Search ..... 224/407, 563, 224/572, 901, 901.2, 901.4, 409; 297/5, 188.18, 188.2; 135/66, 67

(56) References Cited

U.S. PATENT DOCUMENTS

| | | | | | |
|---|---|---|---|---|---|
| 2,986,202 | A | * | 5/1961 | Yates | 297/188.2 |
| 3,957,071 | A | * | 5/1976 | Kenner | 135/66 |
| 4,491,257 | A | * | 1/1985 | Ingles | 224/407 |
| 4,930,697 | A | * | 6/1990 | Takahashi et al. | 224/275 |
| 5,154,331 | A | * | 10/1992 | Sanders | 224/407 |
| 5,326,175 | A | * | 7/1994 | Carter | 383/22 |
| D352,260 | S | * | 11/1994 | Adamo | D12/133 |
| 5,417,353 | A | * | 5/1995 | Stall | 224/401 |
| 5,513,789 | A | * | 5/1996 | Woods et al. | 224/407 |
| 5,865,502 | A | * | 2/1999 | Ayers et al. | 297/188.06 |
| 6,182,877 | B1 | * | 2/2001 | Rolfe | 224/407 |
| 6,401,996 | B1 | * | 6/2002 | Thom et al. | 224/407 |
| D477,256 | S | * | 7/2003 | Mills | D12/133 |

OTHER PUBLICATIONS

Reacher Attached by Bracket to Front Leg of Walker; www.alimed.com Site Dated 2001.
Reacher Attached to Cross Bar by Hook and Loop Strap; Dated May 9, 2002.

* cited by examiner

*Primary Examiner*—Janet M. Wilkens
(74) *Attorney, Agent, or Firm*—Ted Masters

(57) ABSTRACT

A method and apparatus for carrying a reacher on a walker includes a bag which is shaped and dimensioned to receive the reacher. Straps on the bag allow the bag to be attached to one of the side assemblies of the walker so that the bag is held in a convenient angled back position. The mouth of the bag is biased open so that the reacher may be easily inserted and removed.

15 Claims, 9 Drawing Sheets

METHOD FOR CARRYING A REACHER ON A WALKER AND APPARATUS THEREFOR

TECHNICAL FIELD

The present invention pertains generally to the field of physical aids, and more particularly to a method and apparatus for carrying a reacher on a walker wherein a reacher-receiving bag is attached to the walker.

BACKGROUND OF THE INVENTION

It is well known that walkers are used to aid handicapped, injured and/or aged individuals to walk with stability and support. Such walker devices typically include four rectangularly spaced supporting tubular legs which are attached to interconnecting crossbars. In some walker embodiments, wheels are added to two of the legs. The walker enables a person to grasp hand grips located on the interconnecting crossbars while obtaining support from the four legs. Samples of such devices are shown in U.S. Pat. Nos. 3,957,071 and 4,074,683. When using walkers, individuals must grasp the hand grips using both hands in lifting and moving the walker a short distance forward, allowing the individual to make a step or two toward the walker, so as to provide stabilized or balanced walking movements.

Although walkers are indeed necessary to facilitate walking by handicapped, injured and/or aged individuals, they have not generally been provided with the added need/convenience for carrying a reacher while they are using the walker. A reacher is a device used by a handicapped, injured and/or aged individual to aid in lifting, moving and/or grasping objects. Typically reachers include a handle with a trigger device that, when pulled, causes a gripping mechanism on the opposite end of the device to close and grip an object. Samples of such devices are shown in U.S. Pat. Nos. 3,860,156 and 5,687,889.

In the past when using a walker, reachers have had to be left behind because it takes two hands to use a walker. This is inconvenient since an individual while or after using a walker might need to grasp an object, but they would be unable to do so since the reacher was necessarily left behind. In addition, some individuals have tried to balance the reacher across their walker while using the walker. This has lead to situations where the reacher would fall off the walker onto the ground. The handicapped, injured and/or aged individuals would then be unable to pick up their reacher and/or might trip and fall upon their reacher that was now lying upon the ground. Such a fall by someone who is handicapped, injured and/or aged could possibly cause serious injury to that individual due to their diminished health and lack of normal physical ability.

In the past, there have been some devices which have been developed to allow users of walkers to carry objects, however they have generally fallen short in providing a device that could adequately carry a reacher. For example, some bags, baskets, and trays have been available for walkers to aid in the carrying of various smaller articles for the convenience/need of users. These bags, baskets, and trays have served their particular purposes to carry certain personal articles and items but none of these have been designed or have been able to carry a reacher. Overall, the prior art has given very little consideration to the development of walker reacher bags to meet the specific needs/conveniences of handicapped, injured or aged individuals. Examples of such prior art are shown in U.S. Pat. Nos. 4,074,683; 4,184,618; 4,449,750; 4,491,257; 4,659,099; 4,676,416; 4,800,911; 4,974,760; and 5,012,963. These bags, baskets, and trays created for walkers have heretofore suffered from a number of disadvantages when it comes to carrying a reacher:

(a) The aforementioned walker bags, baskets, and trays are too small, short and not designed to carry a reacher. The typical reacher is normally 26" long with many reachers extending up to a length of 32". The typical width of a reacher is approximately 5". The length and width of these reachers make the carrying of these reachers nearly impossible while using a walker since current bags, baskets and trays for walkers are not designed for the long length and width of a reacher. Typically if an individual attempted to place their reacher in the aforementioned walker bags or baskets, the reacher would fall out since the length of the reacher would prevent adequate retention of the reacher. In addition, the reacher could not be stored adequately on a tray since trays are normally flat and smooth and a reacher's length and design is such that the reacher would slide and fall off the tray.

(b) Further, these walker bags, baskets, and trays are not located in a position on the walker where it is ergonomically adequate for a user to carry a reacher so that it would be easily accessible. Typically these walker bags, baskets and trays are located near the top of the walker at approximately the waist of the individual and many times located in between the support bars of the walker. Even if the reacher somehow was able to be stored in one of these bags or baskets it would be difficult for an individual who was handicapped, injured and/or aged to place the reacher in these baskets or bags and then lift the reacher out for use. While standing, the user would need to lift the reacher vertically normally 26", starting in front of the user with the handle beginning above the waist. This sort of lifting is difficult, if not impossible, to perform for many handicapped, injured and/or aged individuals who do not have the range of motion or strength to lift a reacher vertically in that manner and to that degree.

To partially solve the aforementioned problems, one supplier of medical and ergonomic medical products has installed a bracket on the walker, which allows the reacher to be removably attached to one leg of the walker. The bracket is mounted on one front leg of the walker. When the reacher is attached to the bracket, the reacher handle is far away from the walker handgrip, and therefore more difficult for the user to grasp. Another procedure for attaching the reacher to the walker comprises a hook and loop strap which is can be attached to the side crossbar of the walker. This device is disadvantageous in that it requires two hands to attach and remove the reacher.

SUMMARY OF THE INVENTION

The present invention is directed to a method for carrying a reacher on a walker, wherein the reacher is placed in a bag which is attached to one of the side assemblies of the walker. The method utilizes a bag which is specifically designed to accept the reacher. The bag is attached to the walker by three straps which ensure that the mouth of the bag is angled toward the user. When a user needs to use the reacher, they simply reach down and lift the reacher out of the bag. After use, the user returns the reacher to the bag for carrying

ADVANTAGES OF THE INVENTION

The reacher bag can be attached to a walker in a matter of seconds.

When installed on the walker, the reacher bag is oriented in an angled-back position so that the mouth is readily accessible to the user for easy insertion and removal of the reacher.

The mouth of the bag is biased partially open so that the reacher may be more easily inserted into the bag.

Hook and loop fasteners provide rapid attachment of the reacher bag to the walker.

The bag is positioned on the walker such that it does not get in the way of the handles that a user would use to move the walker foreword.

The bag fits virtually any walker.

In accordance with a preferred embodiment of the invention, a method for carrying a reacher on a walker includes:

(a) providing a reacher;

(b) providing a walker having a first side assembly connected to a second side assembly, each side assembly including a front leg and a rear leg, the front leg and the rear leg each having a top portion, wherein the top portion of the front leg is connected to the top portion of the rear leg by a crossbar, the crossbar and the rear leg forming a junction therebetween, the crossbar having a hand grip having a forward end;

(c) providing a bag shaped and dimensioned to receive the reacher, the bag having a top having a mouth and an opposite bottom, first and second straps are disposed on substantially opposite sides of the mouth, a third strap is disposed near the bottom below the first strap;

(d) attaching the first strap of the bag to the crossbar of the first side assembly at the forward end of the hand grip, in this fashion, the hand grip prevents the first strap from moving back along the crossbar;

(e) attaching the second strap of the bag near the junction of the crossbar and the rear leg of the first side assembly;

(f) attaching the third strap of the bag to the front leg of the first side assembly;

(g) wherein when attached as in steps (d) through (f) above, the bag resides in an angled back orientation so that the reacher may be conveniently inserted and removed from the bag by a user; and, (h) inserting the reacher into the bag.

Other features and advantages of the present invention will become apparent from the following detailed description, taken in conjunction with the accompanying drawings, which illustrate, by way of example, the principles of the invention.

DETAILED DESCRIPTION OF THE INVENTION

Figure 1:
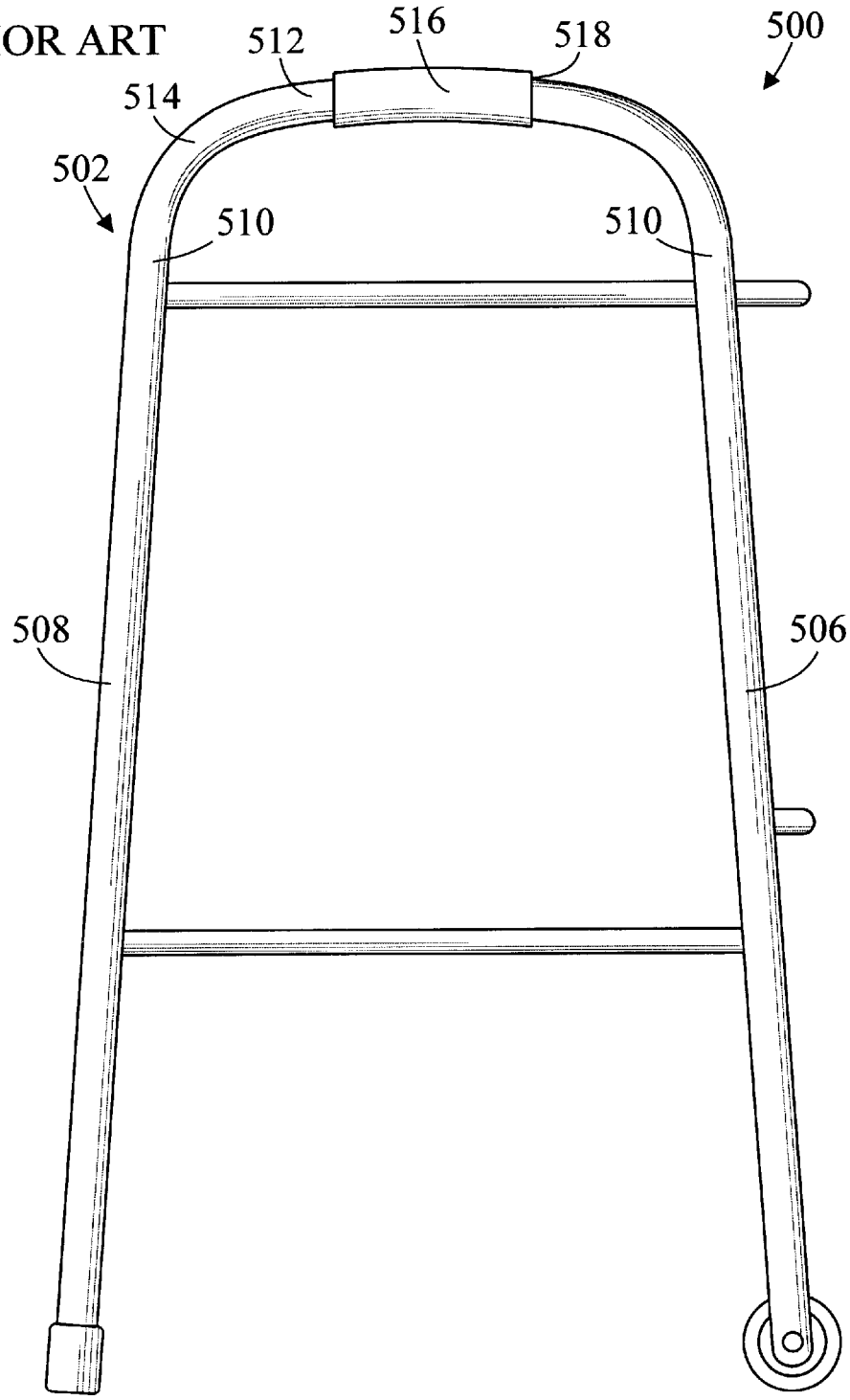
Fig. 1 PRIOR ART
FIG. 1 is a side elevation view of a walker.
Figure 2:
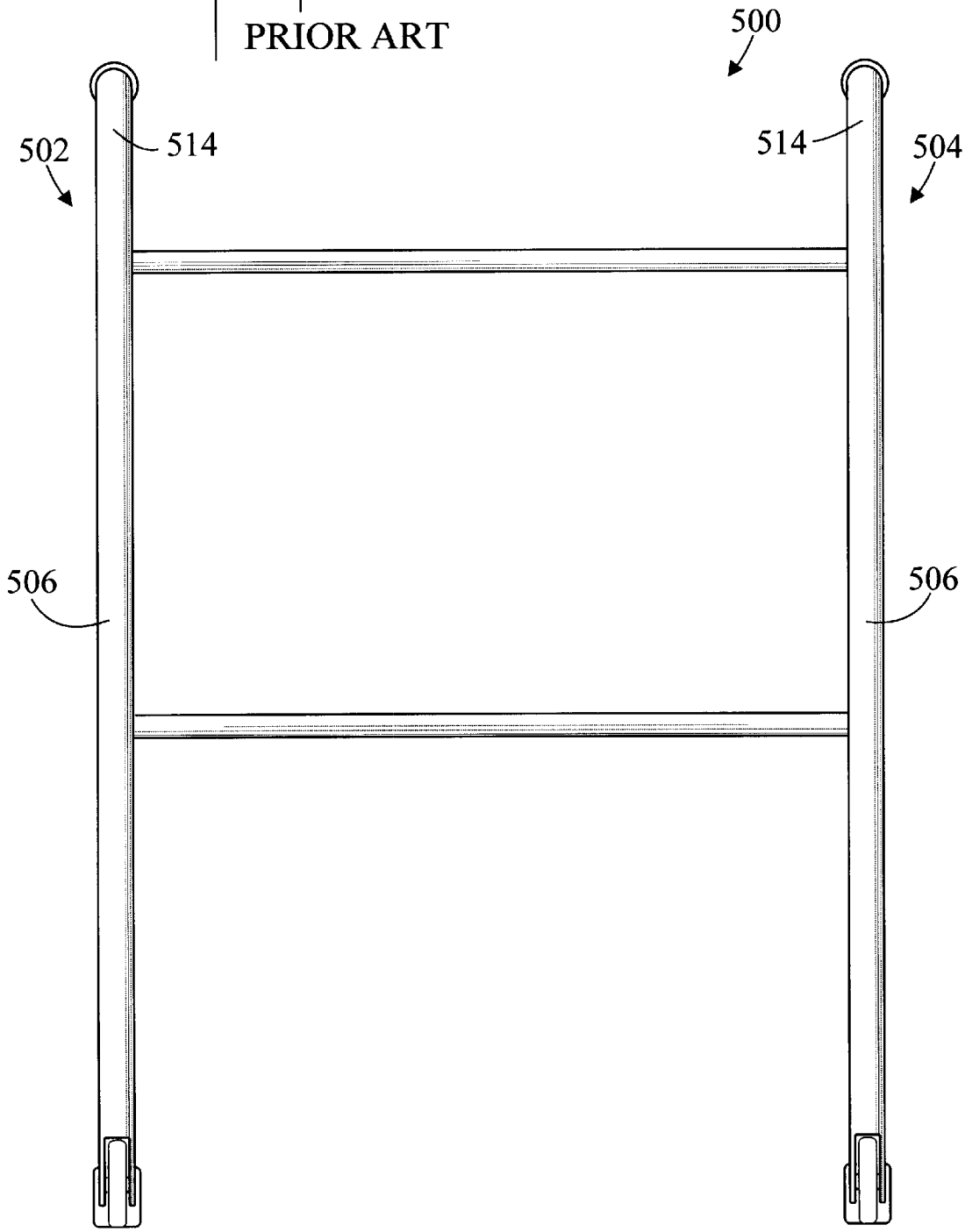
Fig. 2 PRIOR ART
FIG. 2 is a front elevation view of the walker.
Figure 3:
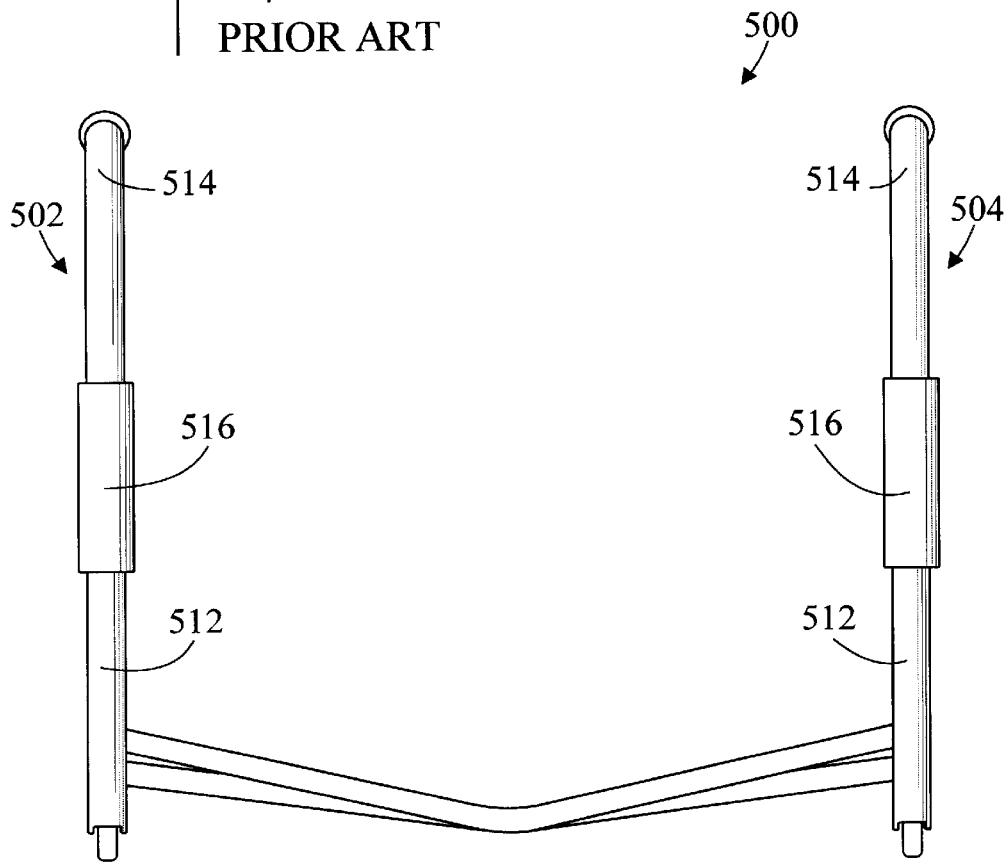
Fig. 3 PRIOR ART
FIG. 3 is a top view of the walker.

Referring initially to FIGS. 1–3, there are illustrated side elevation, front elevation, and top plan views respectively of a prior art walker, generally designated as 500. Walker 500 has a first side assembly 502 connected by cross members to a second side assembly 504, each side assembly including a front leg 506 and a rear leg 508, the front leg 506 and the rear leg 508 each having a top portion 510, wherein the top portion 510 of the front leg 506 is connected to the top portion 510 of the rear leg 508 by a crossbar 512, the crossbar 512 and the rear leg 508 forming a junction 514 therebetween, the crossbar 512 having a hand grip 516 having a forward end 518. In the shown walker embodiment, junction 514 comprises a curved segment.

Figure 4:
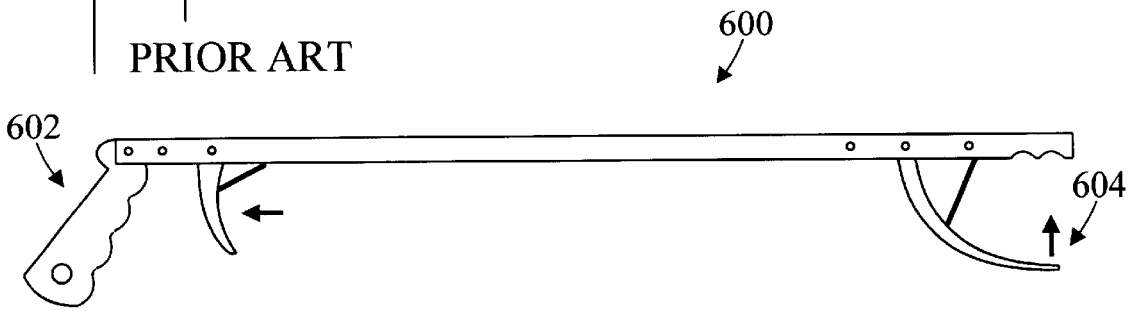
Fig. 4 PRIOR ART
FIG. 4 is side elevation view of a reacher.
Figure 6:
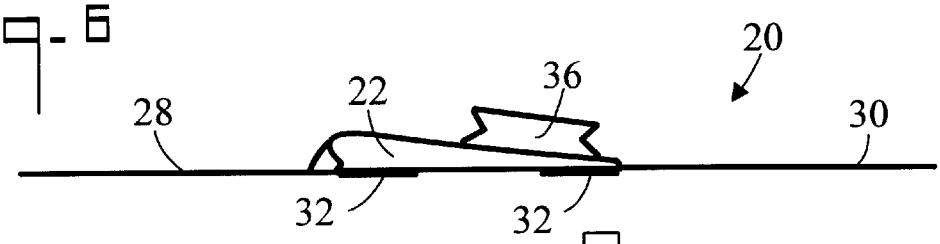
FIG. 6 is an end elevation view showing the mouth of the bag.
Figure 5:
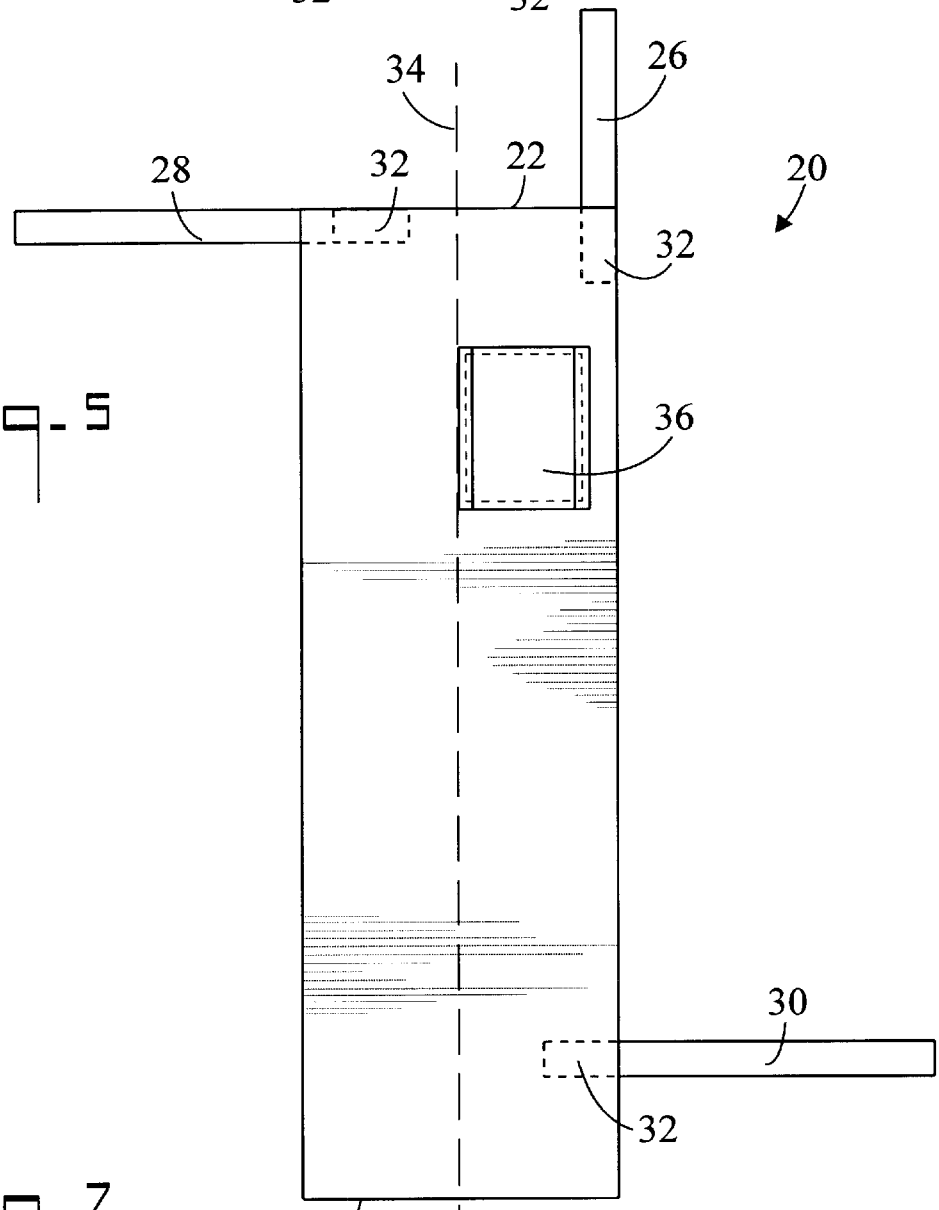
FIG. 5 is a side elevation view of a bag for carrying a reacher in accordance with the present invention.
Figure 7:
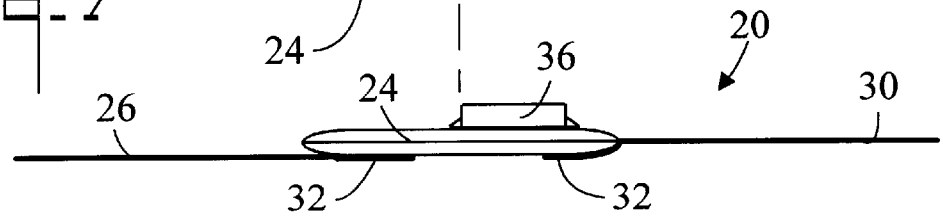
FIG. 7 is an opposite elevation view showing the closed bottom of the bag.
Figure 8:
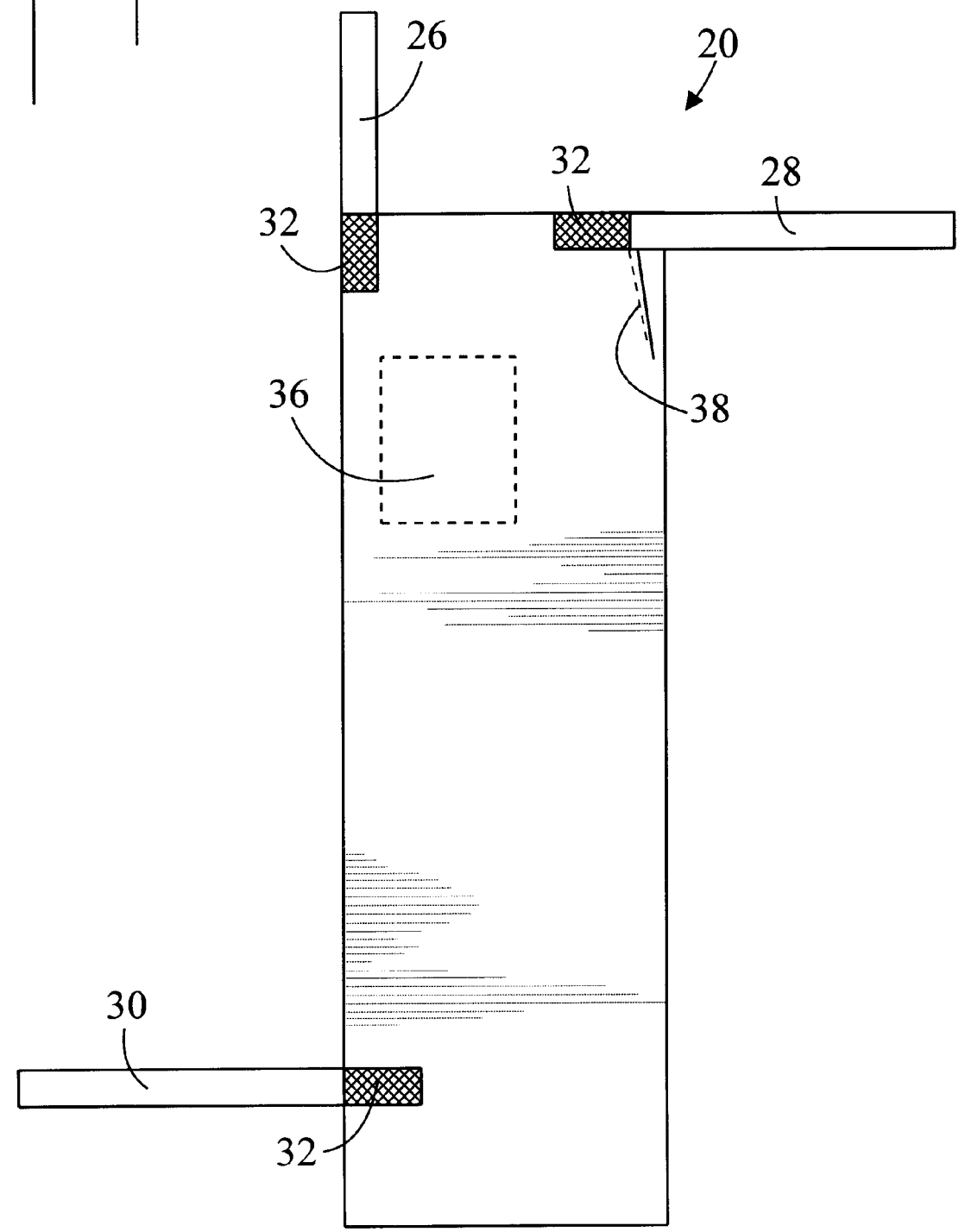
FIG. 8 is an opposite side elevation view of the bag.

Referring now to FIG. 4 this is illustrated a side elevation view of a prior art reacher, generally designated as 600. Reacher 600 has a handle and trigger mechanism 602 at one end and a closeable jaw 604 at an opposite end. When the trigger mechanism 602 is pulled back, the closeable jaw 604 closes in the indicated direction.

Now referring to FIGS. 5–8, there are illustrated side elevation, end elevation, opposite end elevation, and opposite side elevation views respectively of a bag for carrying a reacher 600 on a walker 500 in accordance with the present invention, generally designated as 20. Bag 20 is shaped and dimensioned to receive reacher 600, and in a preferred embodiment is substantially rectangular. Bag 20 has a top having a mouth 22 and an opposite closed bottom 24.

In a preferred embodiment of the invention, bag 20 is fabricated from a light weight flexible material such as fabric, and is about two feet long and seven inches wide. The size may vary to accommodate different size reachers 600.

Bag 20 further includes first 26 and second 28 straps disposed on substantially opposite sides of mouth 22, and a third strap 30 disposed near bottom 24 below first strap 26. In a preferred embodiment of the invention, bag 20 has a longitudinal centerline 34.

First strap 26 is oriented substantially parallel to centerline 34, second strap 28 is oriented substantially perpendicular to centerline 34, and third strap 30 is oriented substantially perpendicular to centerline 34. This arrangement of the straps places the straps in the proper orientation to engage the members of walker 500. Also in a preferred embodiment, one side of straps 26, 28, and 30 include one of hook and loop material. The other of hook and loop material is disposed on bag 20 in locations 32, so that straps 26, 28, and 30 may be looped around the first side assembly 502 and then secured to bag 20 (refer also to FIGS. 9 and 11). It may be appreciated that while straps having hook and loop material comprises a preferred method of attaching bag 20 to walker 500, other attachment means such as snaps, buckles, and the like could also be employed.

In another preferred embodiment of the invention, bag 20 includes an external pocket 36 disposed near mouth 22 and substantially forward of centerline 34. Pocket 34 may be utilized to hold a cellular telephone or other personal article. By positioning pocket forward of centerline 34, pocket 34 may be accessed by a user without encountering interference from the handle of the inserted reacher 600 (refer to FIG. 12).

Figure 9:
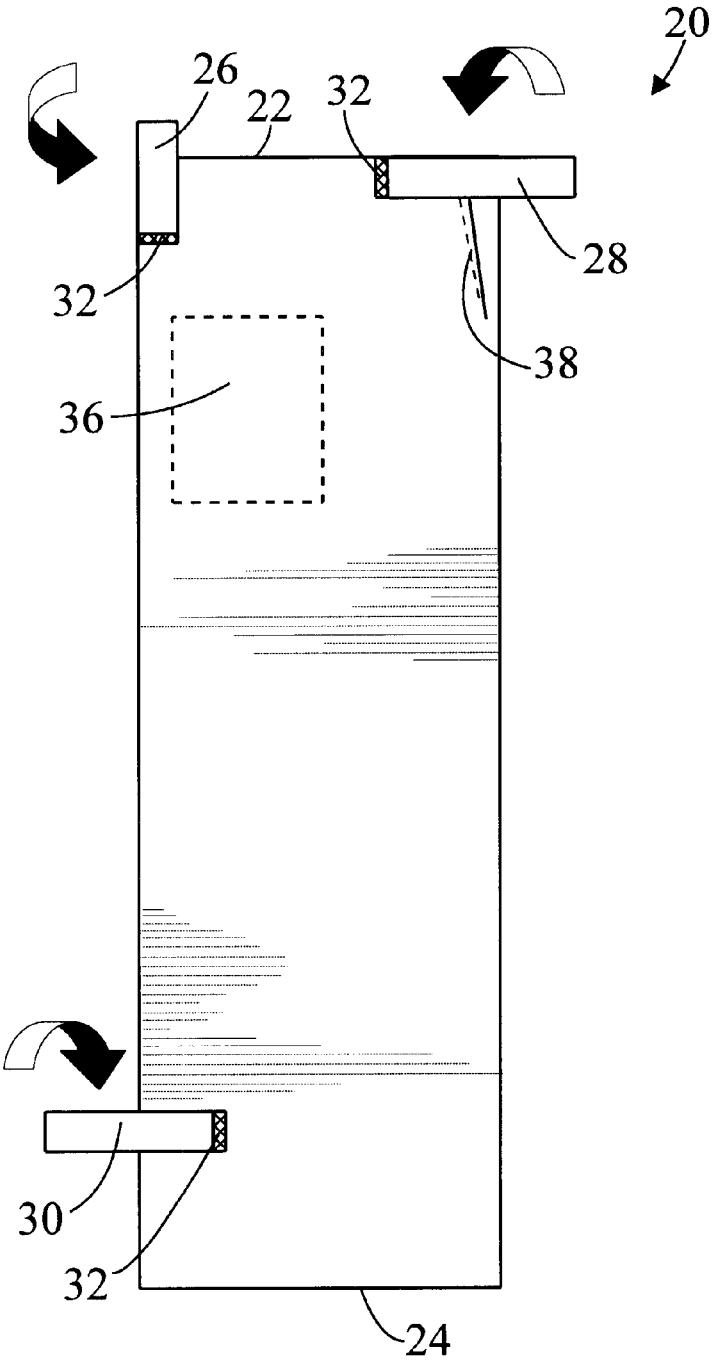
FIG. 9 is a view of the straps of the bag being folded over and connected to the bag.

FIG. 9 is a view of the straps of bag 20 being folded over and connected to the bag 20 such as by the previously discussed hook and loop fasteners.

Figure 10:
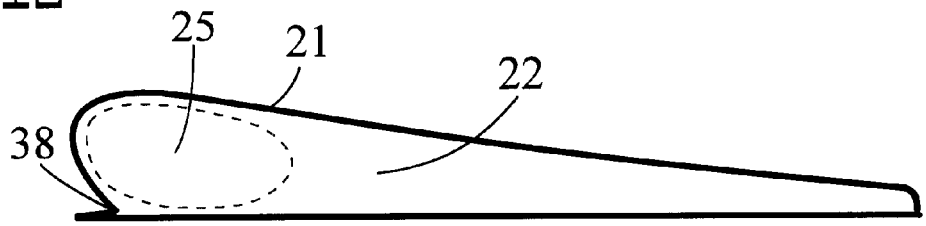
FIG. 10 is an enlarged view of the bag showing a dart which holds the mouth in a partially open position.

FIG. 10 is an enlarged view of mouth 22 of bag 20 showing a dart 38 which holds mouth 22 partially open. In a preferred embodiment, dart 38 is stitched into the fabric 21 of mouth 22 so that mouth 22 is biased into a partially open position such as the shown "airfoil" shape defining an opening 25 (the larger left side of mouth 22 as shown in FIG. 10). By retaining mouth 22 in a partially open state, it is easier for a user to insert reacher 600 into bag 20. It may be appreciated that mouth 22 could also be held open by attaching a loop structurally around mouth 22 such as by sewing.

Figure 11:
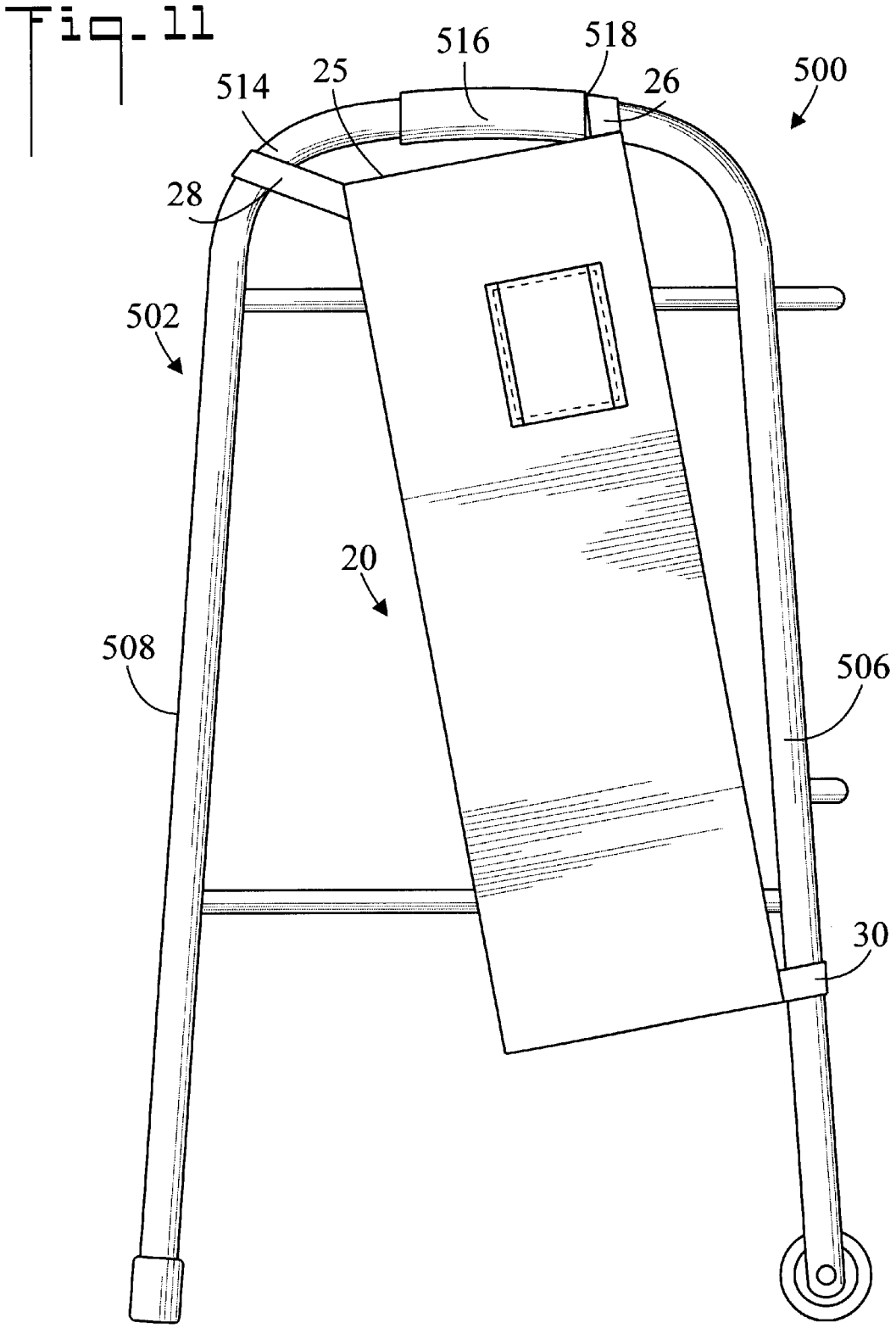
FIG. 11 is a side elevation view of the bag attached to the walker.

FIG. 11 is a side elevation view of bag 20 attached to walker 500. Straps 26, 28, and 30 are wrapped around walker 500 and then connected to bag 20 so that bag 20 angles slightly back toward the walker user. In a preferred embodiment, bag 20 is attached to walker 500 so that opening 25 is positioned toward rear leg 508. With opening 25 to the rear, it is easier for a user to insert reacher 600 into bag 20 by first inserting closeable jaw 604 into opening 25 (refer also to FIG. 12).

Figure 12:
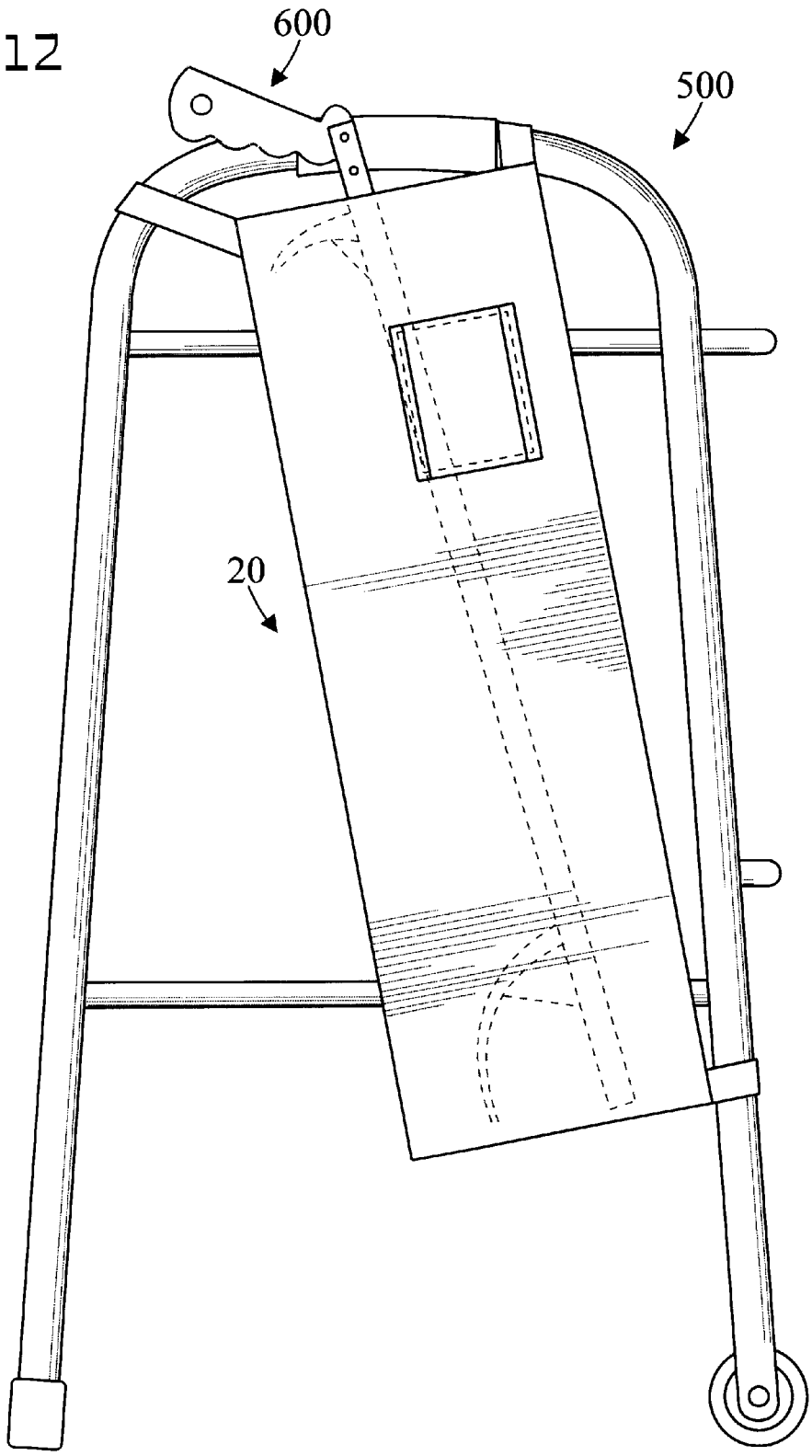
FIG. 12 is a side elevation view of the reacher inserted into the bag; and,.

FIG. 12 is a side elevation view of reacher 600 inserted into bag 20.

Figure 13:
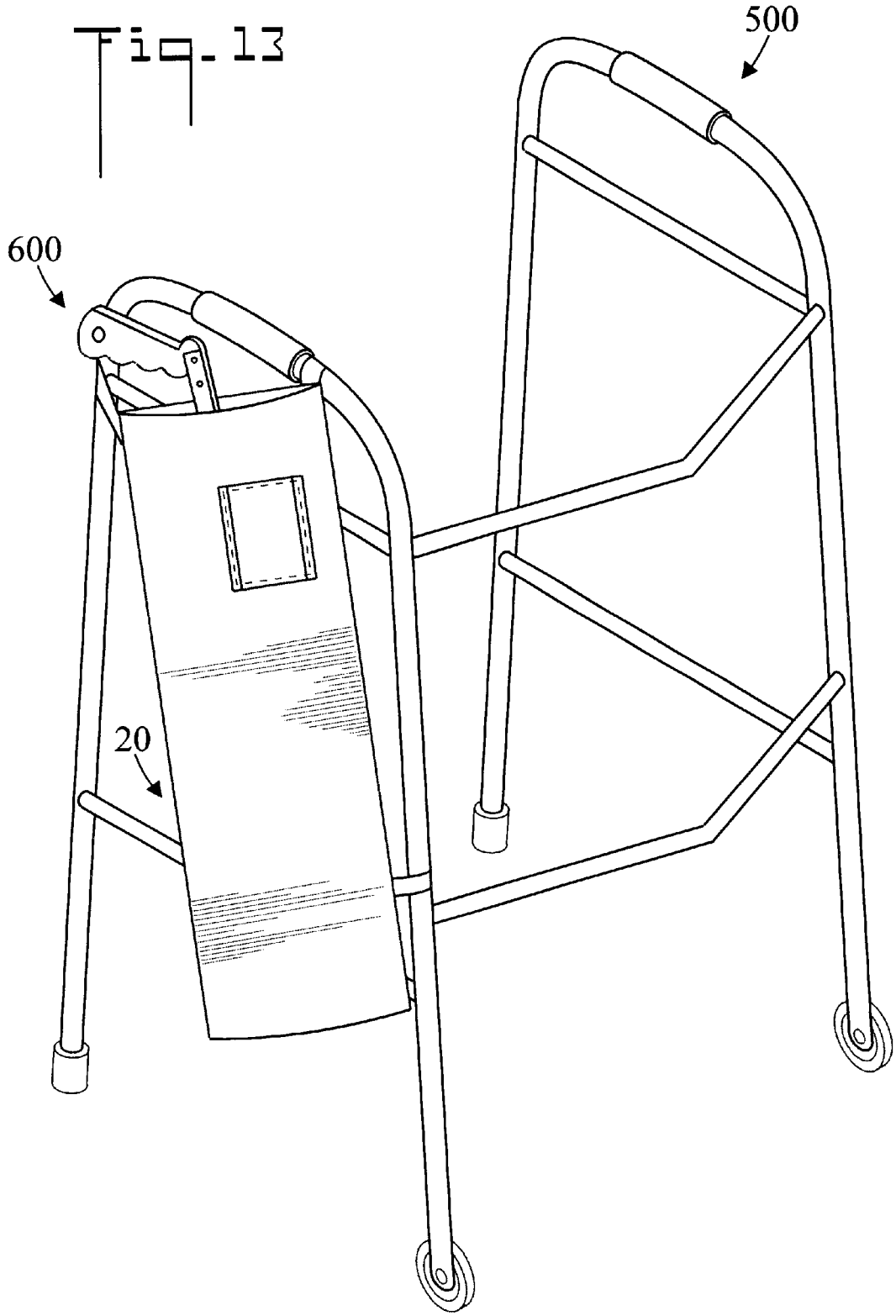
FIG. 13 is a reduced perspective view of the bag and reacher installed on the walker.

FIG. 13 is a reduced perspective view of bag 20 and reacher 600 installed on walker 500.

It may also be appreciated that bag 20 can be made in both right and left handed versions so that it may be attached to either side assembly 502 or 504 of walker 500.

In terms of use, a method for carrying a reacher 600 on a walker 500, includes:

(a) providing a reacher 600 having a handle and trigger mechanism 602 at one end and a closeable jaw 604 at an opposite end;

(b) providing a walker 500 having a first side assembly 502 connected to a second side assembly 504, each side assembly including a front leg 506 and a rear leg 508, the front leg 506 and the rear leg 508 each having a top portion 510, wherein the top portion of the front leg 506 is connected to the top portion 5 10 of the rear leg 508 by a crossbar 512, the crossbar 512 and the rear leg 508 forming a junction 514 therebetween, the crossbar 512 having a hand grip 516 having a forward end 518;

(c) providing a bag 20 shaped and dimensioned to receive the reacher 600, the bag having a top having a mouth 22 and an opposite bottom 24, first 26 and second 28 straps are disposed on substantially opposite sides of the mouth 22, a third strap 30 is disposed near the bottom 24 below the first strap 26;

(d) attaching the first strap 26 of the bag 20 to the crossbar 512 of the first side assembly 502 at the forward end 518 of the hand grip 516, in this fashion, the hand grip 516 prevents the first strap 26 from moving back along the crossbar 512;

(e) attaching the second strap 28 of the bag 20 near the junction 514 of the crossbar 512 and the rear leg 508 of the first side assembly 502;

(f) attaching the third strap 30 of the bag 20 to the front leg 506 of the first side assembly 502;

(g) wherein when attached as in steps (d) through (f) above, the bag 20 resides in an angled back orientation; and, (h) inserting the reacher 600 into the bag 20.

The method further including:

in step (c), the bag 20 being substantially rectangular.

p The method further including:

in step (c), the bag 20 having a centerline 34, an external pocket 34 disposed near the mouth 22 of the bag, the pocket 36 disposed substantially forward of the centerline 34.

The method further including:

in step (c), the straps including one of hook and loop material; and, the other of hook and loop material disposed on the bag 20 so that the straps may be looped around the first side assembly 502 and secured to the bag 20.

The method further including:

in step (c), the bag 20 having a centerline 34;

the first strap 26 oriented substantially parallel to the centerline 34;

the second strap 28 oriented substantially perpendicular to the centerline 34; and, the third strap 30 oriented substantially perpendicular to the centerline 34.

The method further including:

in step (c), the mouth 22 including a dart 38 so that the mouth 22 is biased into a partially open position defining an opening 25.

The method further including:

in steps (d) through (f), the opening 25 being positioned toward rear leg 508.

The preferred embodiments of the invention described herein are exemplary and numerous modifications, dimensional variations, and rearrangements can be readily envisioned to achieve an equivalent result, all of which are intended to be embraced within the scope of the appended claims.

We claim:

1. A method for carrying a reacher on a walker, comprising:

(a) providing a reacher having a handle and trigger mechanism at one end and a closeable jaw at an opposite end;

(b) providing a walker having a first side assembly connected to a second side assembly, each said side assembly including a front leg and a rear leg, said front leg and said rear leg each having a top portion, wherein said top portion of said front leg is connected to said top portion of said rear leg by a crossbar, said crossbar and said rear leg forming a junction therebetween, said crossbar having a hand grip having a forward end;

(c) providing a bag shaped and dimensioned to receive said reacher, said bag having a top having a mouth and an opposite bottom, first and second straps disposed on substantially opposite sides of said mouth, a third strap disposed near said bottom below said first strap;

(d) attaching said first strap of said bag to said crossbar of said first side assembly at said forward end of said hand grip;

(e) attaching said second strap of said bag near said junction of said crossbar and said rear leg of said first side assembly;

(f) attaching said third strap of said bag to said front leg of said first side assembly;

(g) wherein when attached as in steps (d) through (f) above, said bag resides in an angled back orientation; and, (h) inserting said reacher into said bag.

2. The method according to claim 1, further including:

in step (c), said bag being substantially rectangular.

3. The method according to claim 1, further including:

in step (c), said bag having a centerline, an external pocket disposed near said mouth of said bag, said pocket disposed substantially forward of said centerline.

4. The method according to claim 1, further including:

in step (c), said straps including one of hook and loop material; and, the other of hook and loop material disposed on said bag so that said straps may be looped around said first side assembly and secured to said bag.

5. The method according to claim 1, further including:

in step (c), said bag having a centerline;

said first strap oriented substantially parallel to said centerline;

said second strap oriented substantially perpendicular to said centerline; and, said third strap oriented substantially perpendicular to said centerline.

6. The method according to claim 1, further including:

in step (c), said mouth including a dart so that said mouth is biased into a partially open position defining an opening.

7. The method according to claim 6, further including:

in steps (d) through (f), said opening being positioned toward said rear leg.

8. A bag for carrying a reacher on a walker, the reacher having a handle and trigger mechanism at one end and a closeable jaw at an opposite end, the walker having a first side assembly connected to a second side assembly, each side assembly including a front leg and a rear leg, the front leg and the rear leg each having a top portion, wherein the top portion of the front leg is connected to the top portion of the rear leg by a crossbar, the crossbar and the rear leg forming a junction therebetween, the crossbar having a hand grip having a forward end, said bag comprising:

said bag shaped and dimensioned to receive the reacher;

said bag having a top having a mouth and an opposite bottom;

first and second straps disposed on substantially opposite sides of said mouth, a third strap disposed near said bottom below said first strap;

so that, said first strap of said bag may be attached to the crossbar of the first side assembly at the forward end of the hand grip, said second strap of said bag may be attached near the junction of the crossbar and the rear leg of the first side assembly, and said third strap of said bag may be attached to the front leg of the first side assembly, and when so attached, said bag residing in an angled back orientation.

9. A bag according to claim 8, further including:

said bag being substantially rectangular.

10. A bag according to claim 8, further including:

said bag having a centerline, an external pocket disposed near said mouth of said bag, said pocket disposed substantially forward of said centerline.

11. A bag according to claim 8, further including:

said straps including one of hook and loop material; and, the other of hook and loop material disposed on said bag so that said straps may be looped around the first side assembly and secured to said bag.

12. A bag according to claim 8, further including:

said bag having a centerline;

said first strap oriented substantially parallel to said centerline;

said second strap oriented substantially perpendicular to said centerline; and, said third strap oriented substantially perpendicular to said centerline.

13. A bag according to claim 8, further including:

said mouth including a dart so that said mouth is biased into a partially open position defining an opening.

14. A bag according to claim 13, further including:

in steps (d) through (f), said opening being positioned toward said rear leg.

15. A bag according to claim 8, further including:

said bag being substantially rectangular;

said straps including one of hook and loop material;

the other of hook and loop material disposed on said bag so that said straps may be looped around the first side assembly and secured to said bag;

said bag having a centerline;

said first strap oriented substantially parallel to said centerline;

said second strap oriented substantially perpendicular to said centerline;

said third strap oriented substantially perpendicular to said centerline; and, said mouth including a dart so that said mouth is biased into a partially open position defining an opening.

* * * * *